US005673448A

United States Patent [19]

Lang et al.

[11] Patent Number: 5,673,448

[45] Date of Patent: Oct. 7, 1997

[54] SPORT BOOT LINER AND METHOD FOR MAKING SAME

[75] Inventors: Herbert Lang; Byron Gracie; Robert Watt, all of Burnaby, Canada

[73] Assignee: Intuition Sports Incorporated, Vancouver, Canada

[21] Appl. No.: 436,189

[22] PCT Filed: Nov. 4, 1993

[86] PCT No.: PCT/CA93/00458

§ 371 Date: May 4, 1995

§ 102(e) Date: May 4, 1995

[87] PCT Pub. No.: WO94/09663

PCT Pub. Date: May 11, 1994

[51] Int. Cl.[6] ..... A43D 9/00; A43D 11/00

[52] U.S. Cl. ..... 12/142 R; 12/142 P; 36/10; 36/55; 36/88; 36/93; 36/117.6

[58] Field of Search ..... 36/10, 55, 119, 36/88, 93, 154, 117.6, 117.7, 54, 50.1, 2 R, 9 R; 12/146 R, 142 R, 146 M, 142 N, 142 P

[56] References Cited

U.S. PATENT DOCUMENTS

| | | | |
|---|---|---|---|
| 581,777 | 5/1897 | Secker | 36/50.1 |
| 1,294,965 | 2/1919 | Sneva | 36/50.1 |
| 2,244,030 | 6/1941 | Teehan . | |
| 2,933,831 | 4/1960 | Compte | 36/50.1 |
| 3,325,919 | 6/1967 | Robinson | 36/93 |
| 3,362,091 | 1/1968 | Drago . | |
| 3,521,385 | 7/1970 | Dalebout . | |
| 3,581,412 | 6/1971 | Dalebout . | |
| 3,609,887 | 10/1971 | Hickmann et al. | 36/119 |
| 3,613,271 | 10/1971 | Geller . | |
| 3,641,688 | 2/1972 | von den Benken . | |
| 3,694,940 | 10/1972 | Stohr . | |
| 3,750,310 | 8/1973 | Messner et al. . | |
| 3,786,580 | 1/1974 | Dalebout . | |
| 3,798,799 | 3/1974 | Hanson et al. . | |
| 3,848,286 | 11/1974 | Kahmann | 36/119 |
| 3,848,287 | 11/1974 | Simonsen . | |
| 3,857,133 | 12/1974 | Linenfelser . | |
| 3,895,405 | 7/1975 | Edwards | 36/93 |
| 4,068,337 | 1/1978 | Hanson et al. . | |
| 4,078,322 | 3/1978 | Dalebout . | |
| 4,182,056 | 1/1980 | Dalebout . | |
| 4,268,931 | 5/1981 | Salomon . | |

(List continued on next page.)

FOREIGN PATENT DOCUMENTS

| | | | |
|---|---|---|---|
| 467880 | 9/1950 | Canada . | |
| 0 004 829 | 3/1979 | European Pat. Off. . | |
| 2 435 217 | 9/1978 | France . | |
| 2 460 118 | 6/1979 | France . | |
| 2460118 | 2/1981 | France | 36/10 |
| WO 87/01566 | 3/1987 | WIPO . | |

*Primary Examiner*—M. D. Patterson
*Attorney, Agent, or Firm*—Oyen Wiggs Green & Mutala

[57] ABSTRACT

A liner for a sport boot shell and a method for making a custom fitted liner for a sport boot, are disclosed. The liner is designed to be worn inside a boot shell. In a preferred embodiment the liner includes inner and outer of flaps which wrap in opposite directions across a wearer's shin and forms a compound curve in a region in front of the wearer's ankle. The liner including flaps may be made from a single piece of thermoplastic foam material of uniform thickness. The design of the liner prevents the cuff of the liner from loosening around the wearer's shin and calf when the wearer's leg is flexed forward at the ankle. The shell can therefore be worn more loosely than is necessary with a boot liner of conventional design. The liner may be made by making an unfitted liner from a sheet of thermoformable material. The unfitted liner has a forwardly facing opening and wings extending forwardly on either side of opening. The unfitted liner is then heated to above the thermoforming temperature of the material and simultaneously fitted to the shell and the wearer's foot and leg by the steps of: placing the wearer's foot into the unfitted liner; forming flaps by wrapping the wings across the wearer's shin; holding the unfitted liner in place with an elastic stocking; inserting the wearer's foot, the unfitted liner and the elastic stocking into the shell and allowing the unfitted liner to cool.

16 Claims, 5 Drawing Sheets

U.S. PATENT DOCUMENTS 4,301,564 11/1981 Dalebout ..... 36/93
4,414,762 11/1983 Salomon et al. .
4,433,494 2/1984 Courvoisier et al. .
4,649,656 3/1987 Cox et al. ..... 36/9 R
4,654,986 4/1987 George .
4,756,096 7/1988 Meyer .
4,770,648 9/1988 Gillis .
4,837,884 6/1989 Hilgarth .
4,964,229 10/1990 Laberge .
5,003,710 4/1991 Pozzobon .
5,024,006 6/1991 Kiyosawa .
5,067,258 11/1991 Martignago .
5,111,598 5/1992 Sartor et al. .
5,386,649 2/1995 Paris ..... 36/10
5,544,433 8/1996 Borsoi et al. ..... 36/117.7

SPORT BOOT LINER AND METHOD FOR MAKING SAME

This application is a 371 application of PCT/CA93/00458 filed on Nov. 4, 1993.

FIELD OF THE INVENTION

This invention relates to a method for making a custom fitted liner for a sport boot, to a liner for a sport boot such as a ski boot, and to a sport boot incorporating such a liner.

BACKGROUND OF THE INVENTION

Specialized boots are used in many sports such as skiing, snow boarding, ice skating, roller skating, and in-line roller skating. A widely used construction for a sport boot has a rigid or semi-rigid outer shell and a padded inner liner. It is important that the liner fit the wearer well if maximum performance is to be achieved.

In such boots, the outer shell of the boot and the inner liner open to permit entry of the wearer's foot. After the wearer's foot is in place, the outer shell is fastened shut with buckles, laces, or some other fastening means to hold the liner snugly around against wearer's foot and lower leg.

Three characteristics that are required in most high performance sport boots are lateral stiffness, a degree of forward flex at the ankle and a snug fit to provide the wearer with fine control over the motion of the boot. For example, in a ski boot, lateral stiffness is required to allow the skier to control the angle of the edges of the skis relative to the snow; forward flex is required to allow the skier to move his or her centre of gravity relative to the ski and to allow the skier to bend at his or her ankles to accommodate changes in the terrain; and, a snug fit is required so that small motions of the skiers foot are translated into precise changes in the position of the ski attached to the boot.

A problem faced by sport boot manufacturers is to design a boot capable of maintaining a snug fit around the wearer's calf and heel when the wearer flexes his or her leg forward in the boot. Flexing forward tends to cause the wearer's heel to lift. This problem is made worse because the pressure of the wearer's shin on the front of the boot liner tends to enlarge the opening in the upper portion of the liner. This makes it easier for the wearer's calf to pull away from the back of the boot liner when the wearer flexes his or her leg forward at the ankle.

Prior art sport boot liners have the disadvantage that the pressure of a wearer's shin on the front portion of the liner tends to cause the portion of the liner which encircles the wearer's leg at the cuff to loosen. This generally occurs because the closure in conventional boot liners opens when pressure is placed on the shin portion of the liner. For example, in a boot liner with a conventional front closure comprising a slit covered by a conventional tongue, the pressure of the wearer's shin on the tongue will cause the tongue to slip forward relative to the rest of the liner when the wearer's leg is flexed forward, thereby causing the liner to loosen around the wearer's calf.

Boot manufacturers have devised various attempted solutions to this problem. Most of the attempted solutions include providing fastening means associated with the boot shell for closing the shell tightly around the inner liner at the cuff. A disadvantage of keeping the liner snugly fitted about the wearer's calf and shin even when the wearer's leg is not flexed is that it can cut off blood circulation in the wearer's foot and lead to discomfort. Some manufacturers provide boots having various designs of clamp to positively hold the wearer's heel down. These designs can cause pressure points on the wearer's heel and achilles tendon area. They also require precise adjustment to accommodate the foot of an individual wearer.

Another problem faced by sport boot manufacturers is to provide a comfortable sport boot liner which provides good control by closely fitting the top of a wearer's foot, especially in the region of the forefoot just in front of the wearer's ankle.

U.S. Pat. No. 3,786,580, Dalebout discloses a double-walled inner liner for a sport boot which can be custom moulded to a wearer's foot by injecting a foamed elastomeric material under pressure into a cavity between the walls in the liner. This boot liner has disadvantages which are well known in the art in respect of injectable foam liners. The Dalebout liner has a forward facing slit opening for entry of a wearer's foot. The opening is closed by a narrow leather flap and is surrounded by padded material. The design of the opening does not permit the liner to be moulded to a wearer's foot in the vicinity of the opening.

FR 2,435,217, Blanc discloses a method for forming a sheet of thermoformable plastic material to the shape of the bottom of a wearer's foot. The method involves the steps of heating a sheet of the thermoplastic material, placing it inside an inflatable slipper, fitting the slipper around a wearer's foot and inflating the slipper to press the material against the bottom of a wearer's foot. This method does not provide any fitting in the areas of the wearer's Achilles tendon, ankle or shin.

EP-A-0 004 829 discloses various items of sports equipment which comprise rigid outer shells with pads comprising a heating element sandwiched between layers of thermoformable plastic material bonded to the outer shells at selected points. These items of sports equipment require embedded heating elements and do not disclose a design which can be fitted closely to a wearer's forefoot area or which provides for a front opening.

FR-2 460 118 discloses a sock like ski-boot liner made of a thermally expandable material. The liner is fitted to fill the voids between a boot shell and wearer's foot by heating the liner with an electric heating element.

SUMMARY OF THE INVENTION

The invention provides a method for forming a custom-fitted sport boot liner for wearing inside a sport boot shell. The method comprises the steps of: providing an unfitted liner comprising a thermoformable material, said material having a thermoforming temperature, said unfitted liner having a hollow foot receiving portion and a hollow lower-leg receiving portion, said lower-leg receiving portion comprising first and second side edges, said side edges defining free edges of first and second wings; heating said unfitted liner to a temperature above said thermoforming temperature; placing a person's foot and lower leg into said unfitted liner with said foot in said foot-receiving portion and said lower leg in said lower-leg receiving portion; wrapping said first wing in front of said person's lower leg in a first direction; wrapping said second wing in front of said person's lower leg outside of and overlapping with said first wing in a second direction opposite to said first direction; placing said person's foot and lower leg and unfitted liner inside said sport boot shell to simultaneously shape an inside surface of said unfitted liner to conform to said wearer's foot and an outside surface of said unfitted liner to conform to an inside surface of said sport boot shell; and allowing said unfitted liner to cool to a temperature below said thermoforming temperature.

The invention also provides a sport boot liner for wearing inside a sport boot shell. The liner comprises: a hollow generally horizontal foot receiving portion having a central longitudinal axis; and a hollow generally vertical lower-leg receiving portion comprising a calf receiving portion a shin receiving portion, an ankle-receiving area adjacent the ankle of a human wearer of said liner; a cuff circumscribing a rounded opening, said cuff being above a horizontal plane through said ankle-receiving area; and first and second side edges said side edges defining free edges of first and second flaps overlapping in a forward facing overlap area; wherein said first flap is wrapped in a first direction across said overlap area and said second flap is wrapped across said overlap area in a second direction, opposite to said first direction, and outside of said first flap and said overlap area extends at least over a region between said horizontal plane and a point adjacent said wearer's forefoot and spaced forward from said ankle-receiving area.

BRIEF DESCRIPTION OF THE DRAWINGS

By way of illustration the invention will now be described with reference to the following drawings which illustrate specific embodiments of the invention but which should not be construed as restricting the scope or spirit of the invention in any way.

DETAILED DESCRIPTION OF THE PREFERRED EMBODIMENT

For clarity the invention will now be described as embodied in a method for making a liner for an alpine ski-boot and the resulting liner. Many other varieties of sport boot such as skating boots and snow boarding boots may also be constructed according to the invention in ways which will be obvious to one who understands the following description. Also, a liner according to the invention may be constructed according to other methods.

Figure 1:
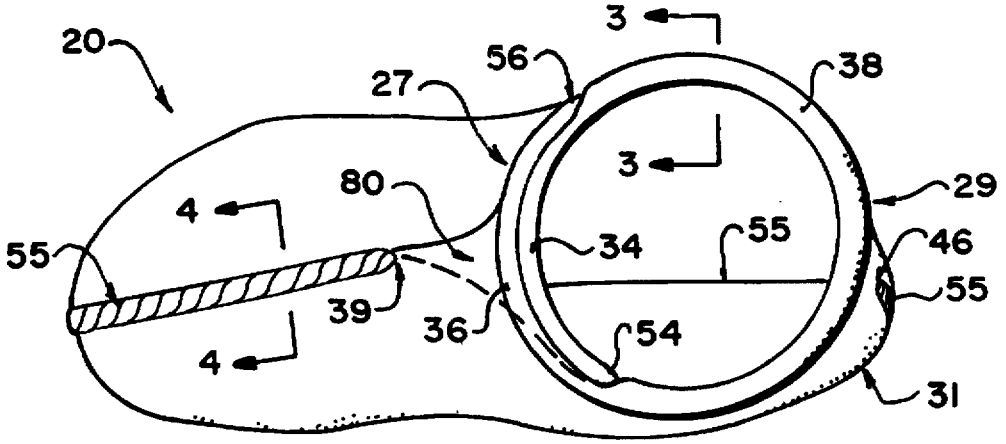
FIG. 1 is a top view of an alpine ski-boot liner according to the invention.
Figure 7:
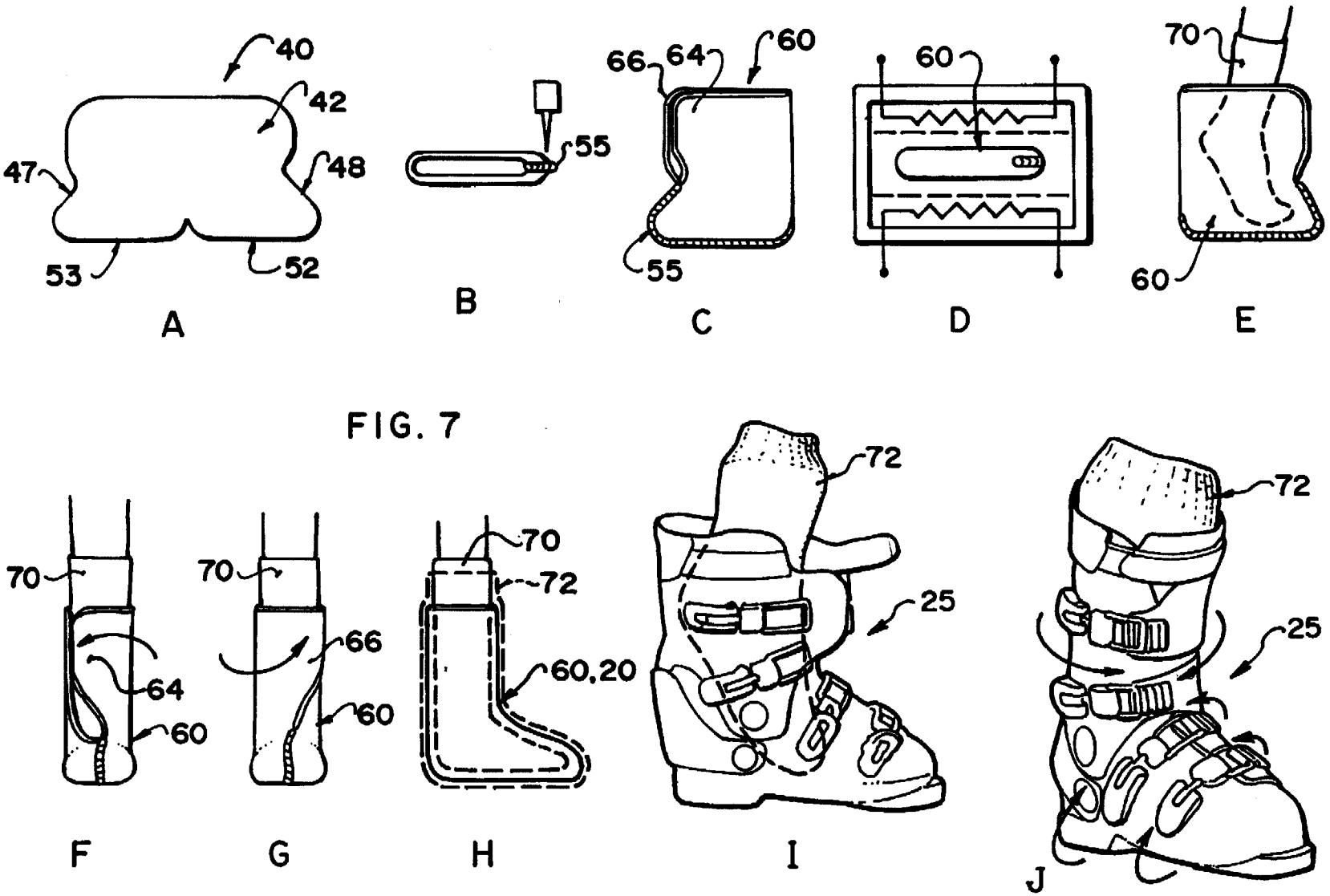
FIGS. 7A, 7B, 7C, 7D, 7E, 7F, 7G, 7H, 7I and 7J illustrate the steps in a method for making the liner of FIG. 1.

FIG. 1 shows a sport-boot liner 20 according to the invention. Liner 20 is in the form of a contoured sock which surrounds a wearer's right foot, calf and shin inside an outer boot shell 25 (FIG. 7I). Liner 20 has a shin area 27 which contacts a wearer's shin and a portion of the top of the wearer's foot, a calf region 29 which contacts the wearer's calf and a heel region 31 which contacts the wearer's heel. A liner for wearing on the wearer's left foot would be a mirror image of liner 20.

Shin area 27 comprises a pair of overlapping flaps 34, 36. Inner flap 34 and outer flap 36 each wrap completely around the front of the wearer's shin. Preferably outer flap 36 wraps toward the outside of the wearer's foot and inner flap 34 wraps toward the inside of the wearer's foot. In a liner to be worn on a right foot, outer flap 36 preferably wraps in a clockwise direction and inner flap 34 wraps in a counter-clockwise direction. The opposite applies to a liner for a left foot.

Free edge 54 of inner flap 34 and free edge 56 of outer flap 36 may be tapered in thickness so that there are not any sudden large changes in thickness of liner 20 which would be likely cause pressure points on the wearer's leg or foot. Outer flap 36 is preferably indented along free edge 54 of inner flap 34 so that free edge 54 does not press uncomfortably into the leg of a wearer.

Figure 2:
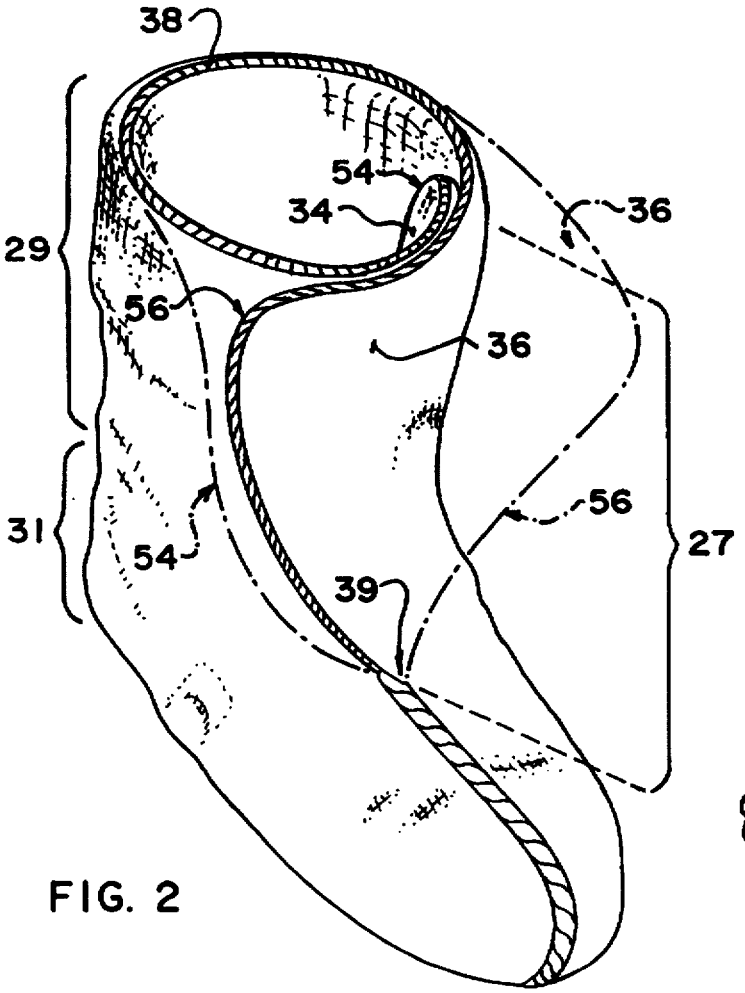
FIG. 2 is a perspective view of the ski-boot liner of FIG. 1.

Flaps 34 and 36 form a double thickness of material in shin area 27 when liner 20 is being worn. The uppermost portions of flaps 34 and 36 extend generally vertically along the shin of a wearer. In their portions below a horizontal plane through the wearer's ankle, flaps 34 and 36 curve upwardly and extend along the top of the wearer's foot to Point 39. Point 39 is preferably situated centrally on the wearer's forefoot (metatarsus) behind the wearer's toes and between the forward portion of the wearer's arch and the region generally above the ball of the wearer's foot. Point 39 may be located within 1.5 cm of a wearer's meta-tarsal joint. Flaps 34 and 36 overlap in an area extending from point 39 to cuff 38. The region 80 of the area in which flaps 34 and 36 overlap below approximately a horizontal plane passing through the ankle of a wearer curves to follow generally the contour of the wearer's forefoot. In region 80 flaps 34 and 36 have a compound curvature following the saddle-like shape of the wearer's shin, ankle and forefoot. Liner 20 can be easily opened for inserting or removing the wearer's foot by grasping flaps 34 and 36 and peeling them outwardly. The dashed lines in FIG. 2 show flap 36 in a peeled back position.

Figure 5:
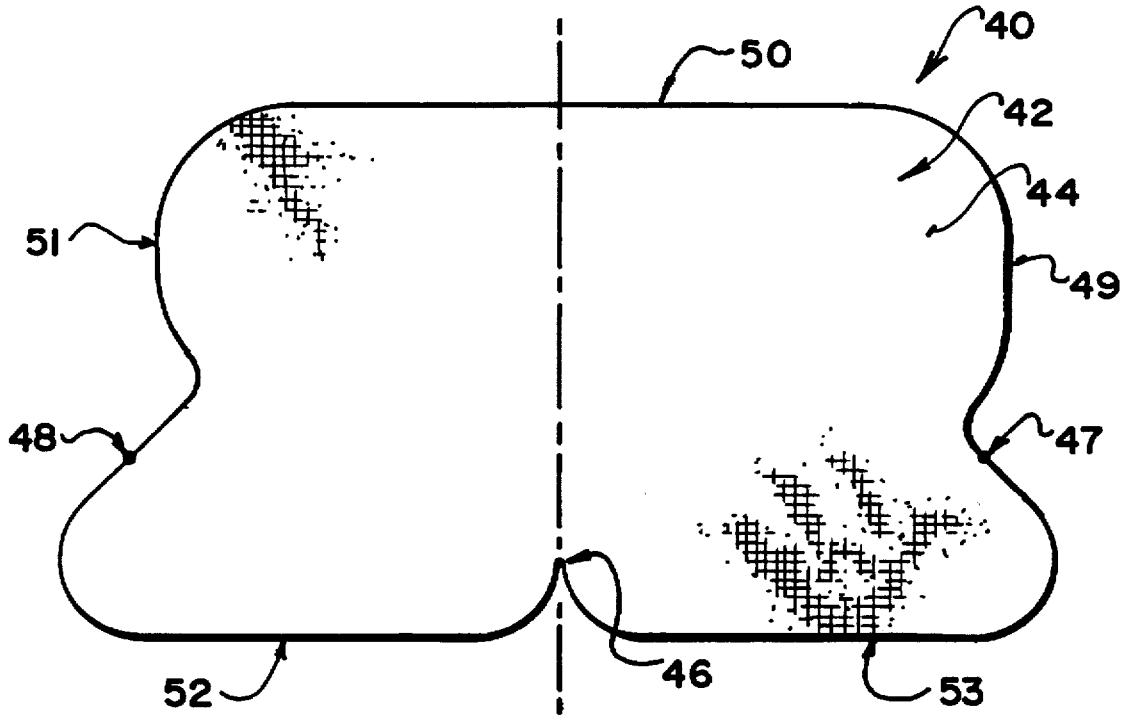
FIG. 5 is a plan view of a blank of sheet material cut to form the liner of FIG. 1.

Liner 20 can be made from a blank 40 of sheet material 42 cut as shown in FIGS. 5 and 7A. The correspondence between the parts of liner 20 shown in FIGS. 1 and 2 and the parts of blank 40 shown in FIG. 5 is as follows: edge 50 corresponds to the top edge of cuff 38; edge 51 corresponds to the free edge 54 of inner flap 34; edge 49 corresponds to the free edge 56 of outer flap 36; points 47 and 48 correspond to point 39; edges 52 and 53 correspond to seam 55; and point 46 corresponds to the heelward end of seam 55.

Material 42 is preferably a material which is thermoformable at a temperature low enough that it can be thermoformed while in contact with a wearer's foot while maintaining a surface temperature low enough not to burn the wearer's foot. For example, ULTRALON™ 7.0 pound closed cell EVA foam made by Ultralon Products (N.Z.) Ltd. of Christchurch New Zealand is a suitable material. This material provides good cushioning for the wearer's foot and yet is firm enough to provide good control of the boot. It is also warm; durable, and is easy to form into a boot liner as described below.

It is highly preferable that material 42 is custom formable. To achieve excellent control of the boot it is desirable that liner 20 be fitted to the wearer's foot in region 80. The human foot has several tendons that pass through the area near point 39. If liner 20 were not custom fitted to the wearer's foot in the area near point 39 then liner 42 would be extremely uncomfortable unless it were made of a soft material in region 80 in which case it would not provide optimum control.

Before being cut to form blank 40 material 42 is preferably laminated on both sides with a layer of fabric 44. Fabric 44 may be, for example, a four-way stretch fabric comprising 79% Nylon and 21% Lycra. Preferably fabric 44 is a slightly heavier weight on the side of material 42 that will become the outside of liner 20. Fabric 44 may be applied by spraying material 42 and fabric 44 with a uniform coating of a suitable adhesive, such as 3-M™ model 77 spray adhesive, and laminating fabric 44 to material 42 under pressure. After fabric 44 has been applied to both sides of material 42 then blank 40 may be cut out by any suitable means such as die cutting.

Fabric 44 somewhat stiffens liner 20. Fabric 44 makes liner 20 easier to put on than an unlined liner 20 and improves the comfort of liner 20 by making liner 20 less clammy than an unlined liner 20. Fabric 44 also helps to prevent heat loss from material 42 dining fitting so that material 42 is retained above its thermoforming temperature for a longer time. This makes the fitting process described below more reliable because it allows more time to complete the fitting. Furthermore, the slight stiffness of fabric 44 helps to prevent wrinkles from forming during fitting.

Figure 3:
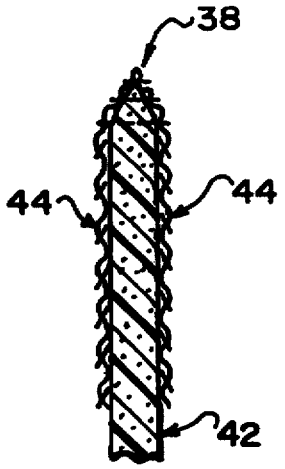
FIG. 3 is a section along line 3—3 of the ski-boot liner of FIG. 1.
Figure 4:
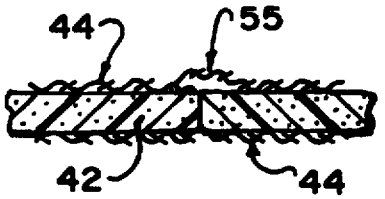
FIG. 4 is a section along line 4—4 of the ski-boot liner of FIG. 1.

Blank 40 is preferably prepared by routing a groove (not shown) between points 47 and 48 along edges 49, 50 and 51. The edges of the routed groove are then stitched together to form a finished tapered edge as shown in FIG. 3. Blank 40 is formed into an unfitted liner 60 (FIGS. 6 and 7C) by bringing points 47 and 48 together and joining side 52 to side 53 between point 46 and points 47 and 48 to form a seam 55. Seam 55 can be made by stitching or, if material 42 is weldable, by welding. However, seam 55 is preferably made by bonding with a suitable adhesive and stitching along the resulting joint (FIG. 7B). The adhesive used to form seam 55 preferably does not harden when it is chilled. If the adhesive in seam 55 does harden at low temperatures then the hard adhesive could cause pressure points on the wearer's foot when liner 20 is worn skiing or in other cold weather sports. It has been found that when material 42 is the ULTRALON™ closed cell foam described above that HELMIPRENE™ model C8130-3 glue made by the Helmitin company is a suitable adhesive. As shown in FIG. 4, seam 55 is preferably stitched so that seam 55 is flat on the inside of liner 20.

Figure 6:
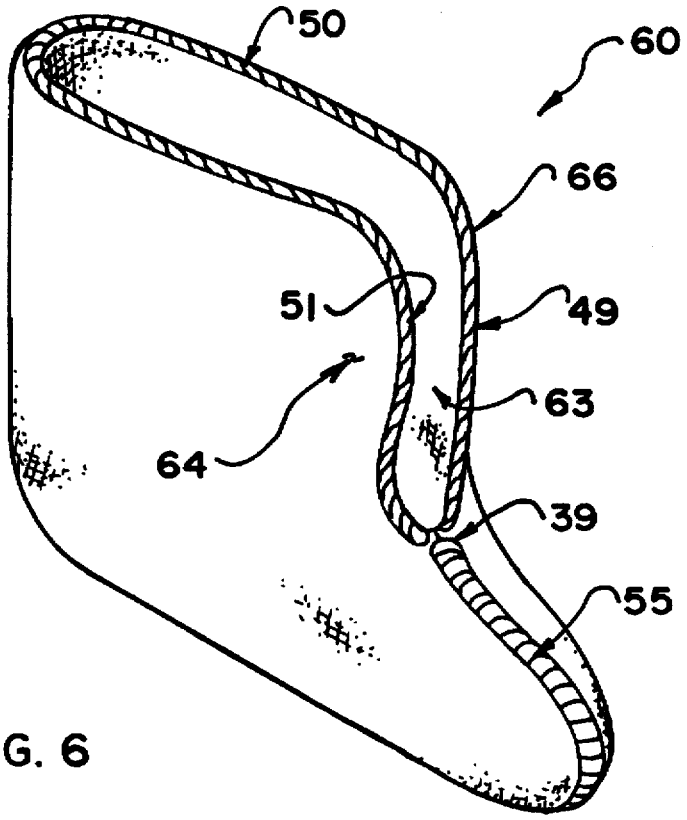
FIG. 6 is a perspective view of an unfitted liner capable of being formed into the ski-boot liner of FIG. 1.

Unfitted liner 60 has a forwardly facing opening 63. Wings 64, 66 extend forwardly along the sides of opening 65 which are respectively on the distal and medial sides of the leg of a wearer. Wings 64 and 66 are preferably asymmetrical as can be seen in FIGS. 5 and 6. Wing 64 which will eventually form inner flap 34 is slightly narrower than and does not extend as far down from cuff 38 as wing 66 which will eventually form outer flap 36. The forward edges of the upper portions of wings 64 and 66 project farther forward than the forward edges of the lower portions of wings 64 and 66.

Unitted liner 60 is fitted to a wearer's foot and to the inside of boot shell 25 by the steps shown in FIGS. 7D through 7J. First, a convection oven is pre-heated to 115 C (240° F.). Pre-heating prevents liner 60 from being overheated by radiant energy from any exposed heating elements in the oven. Then, as shown in FIG. 7D, unfitted liner 60 is placed in the oven and heated for approximately 10 minutes.

Unfitted liner 60 should not be heated to an excessive temperature. If material 42 is a closed cell foam material overheating can cause gas to escape from the cells of the foam. This can cause material 42 to lose some of its cushioning ability and can cause material 42 to shrink. Overheating unfitted liner 60 could also burn the foot of a wearer during the fitting process.

Before the heating of unfitted liner 60 is completed, padding (not shown) is placed around the wearer's toes. The padding prevents the resulting liner 20 from being so well fitted around the wearer's toes that the wearer's toes are held uncomfortably immobile. The padding can be cotton batting placed between the wearer's big toe and second toe, between the wearer's fourth and fifth toes, and sheet cotton batting placed over the ends of all of the toes and covering the last joints of the big and fifth toes. If the wearer has sensitive areas on his or her foot, additional padding may be applied to the sensitive areas to provide some space between those areas and liner 20. After the padding has been applied then the wearer's padded toes and foot are placed inside a short nylon stocking 70.

Next, as shown in FIG. 7E, unfitted liner 60 is removed from the oven and the wearer's foot is placed into heated unfitted liner 60. After the wearer's foot is inside liner 60 wing 64 is wrapped across the front of the wearer's shin and ankle (FIG. 7F) to form flap 34. As wing 64 is wrapped across the wearer's shin, the lowermost portion of wing 64 bends and forums a compound curve which conforms generally with the saddle-shaped curve of the wearer's foot and ankle. Wing 66 is then wrapped outside flap 34, in the opposite direction to wing 64, across the wearer's shin and ankle to form flap 36 (FIG. 7G). As wing 66 is wrapped across the wearer's shin and ankle, the lowermost portion of wing 66 bends and conforms generally with the curve of the wearer's foot and ankle. The top edges of flaps 34 and 36 are then lined up and a second short nylon stocking 72 is rolled on over liner 60 (FIG. 7H).

It is preferable that the wearer's foot be inserted into unfitted liner 60 before unfitted liner 60 is inserted into boot shell 25. If the wearer's foot were pushed into unfitted liner 60 after unfitted liner 60 was inserted into boot shell 25 then material 42 would tend to be forced ahead of the wearer's foot into the toe of shell 25 which could interfere with achieving an optimum fit.

At this point liner 60 is ready for final fitting. As shown in FIG. 7I, boot shell 25 is held open and the wearer places his or her foot inside boot shell 25 until the wearer is standing in boot shell 25. During this step, material 42 is still above its thermoforming temperature. Because liner 60 is being pushed into boot shell 25 by the wearer's foot, material 42 tends to be squeezed slightly toward the wearer's heel as liner 60 presses against the walls of boot shell 25. This tends to increase the volume of material 42 in the region of the wearer's heel. As the wearer pushes his or her heel into position inside shell 25 material 42 flows into heel portion 31 around the wearer's heel and Achilles tendon to form a fitted heel pocket. To assist in the formation of the heel pocket the wearer's heel should be slightly raised and lowered after the wearer is standing inside boot shell 25. This avoids the formation of wrinkles in heel portion 31 and helps to shape the heel pocket.

The interior surface of boot shell 25 typically has small indentations and projections where, for example, buckles are riveted to boot shell 25 or a hinge mechanism is provided to allow flexion of shell 25 at a wearer's ankle. During the fitting process, material 42 flows around such projections and into such indentations to form a cast of the interior of boot shell 25. The close fit between liner 20 and boot shell 25 helps to hold liner 20 in place inside boot shell 25 when liner 20 is being worn inside boot shell 25. If it is desired to retain liner 20 even more firmly in place inside boot shell 25 then additional projections or indentations may be deliberately made on the inside surface of boot shell 25. During fitting liner 20 conforms to such indentations and/or projections.

After the wearer's foot and liner 60 have been inserted into boot shell 25, boot shell 25 is buckled closed around liner 60 as shown in FIG. 7J. During the steps shown in FIGS. 7I and 7J the material 42 of unfitted liner 60 is compressed between the wearer's ankle and shell 25 and between the wearer's forefoot and shell 25 to form unfitted liner 60 to the wearer's ankle and forefoot in region 80 (FIG. 1). At the same time, material 42 in outer flap 36 is indented around edge 54. It is necessary to accomplish all of these steps relatively quickly before unfitted liner 60 cools to a temperature below the thermoforming temperature of material 42.

The transformation of unfitted liner 60 into liner 20 is completed by allowing unfitted liner 60 to cool inside shell 25 until it has cooled to a temperature below the thermoforming temperature of material 42. The duration of this step is typically approximately 5 minutes. During the cooling step it is preferable for the wearer to move his or her foot so that the liner will provide a good fit to the wearer's foot and to boot shell 25. For example, the wearer may bang the heel of boot shell 25 on the ground to firmly seat the wearer's heel, wiggle the wearer's toes for approximately 1 minute and then stand for approximately 3 minutes applying forward pressure in the shin area to flex the boot forward at the ankle so that the wearer is standing in his or her customary skiing stance.

These fitting steps cause the outside surface of unfitted liner 60 to conform to the shape of the inside of boot shell 25 and the inside surface of liner 60 to conform to the shape of the wearer's foot (as modified by any padding which has been applied to the wearer's foot). When material 42 cools to below its thermoforming temperature it retains the shape given to it when it was heated. Approximately 5 minutes after the step of placing the wearer's foot and unfitted liner 60 into boot-shell 25 the wearer's foot and liner 20 may be removed from boot shell 25, stockings 70, 72 and any padding may be removed from the wearer's foot and liner 20 may be reinserted into shell 25 where the wearer can check the fit. The process is then repeated for the wearer's other foot.

An advantage of practising this method with a liner 20 as described above is that in liner 20 flaps 34 and 36 overlap in region 80 between point 39 and the wearer's shin. Therefore, before fitting, there are two thicknesses of material 42 adjacent the top of the wearer's forefoot in region 80. The two layers of material 42 in region 80 provide enough material 42 in region 80 to ensure, if shell 25 is the correct size for the wearer, that there will be enough material 42 in region 80 and adjacent areas to completely fill the gap between the wearer's foot and shell 25. This facilitates a good fit to the wearer's forefoot which is can be important for fine control over the boot.

Liner 20 may also be formed by heating it as described above and placing it on a prosthesis (not shown) in the shape of a human foot and lower leg. Liner 20 may then be pressed against the prosthesis until it has cooled to below its thermoforming temperature. This method produces a liner which is not custom fitted to a wearer's foot and is therefore not preferred.

There are several advantages to manufacturing a ski boot with a liner 20 as described above. Firstly, the design of the liner keeps the top portion of the liner in snug contact with the wearer's shin and calf even when the wearer flexes his or her leg forward. As noted above, prior art boot liners which have a conventional front opening covered by a tongue tend to loosen about the wearer's calf as the wearer flexes his or her leg forward. This is because the wearer's shin applies a significant amount of pressure to the tongue when the wearer's leg is flexed forward. There is nothing to prevent the tongue from slipping forward relative to the rest of the liner. This can cause a space to form behind the wearer's calf. When the liner is not in snug contact with the wearer's calf it is easier for the wearer's heel to lift. The close fit of liner 20 in region 80 also helps to hold the wearer's foot and heel in place. Heel lift can take away from the wearer's comfort and control over the boot.

In a conventional boot the tendency for the cuff of the liner to loosen when the wearer flexes his or her leg forward at the ankle can be compensated for by making the shell of the boot tight when the wearer's leg is not flexed. When this is done there is no room for the liner to loosen when the wearer's leg is flexed forward. The disadvantage of making the boot shell tight is that a tight boot can be uncomfortable and may impair the circulation of blood to the wearer's foot.

Figure 8:
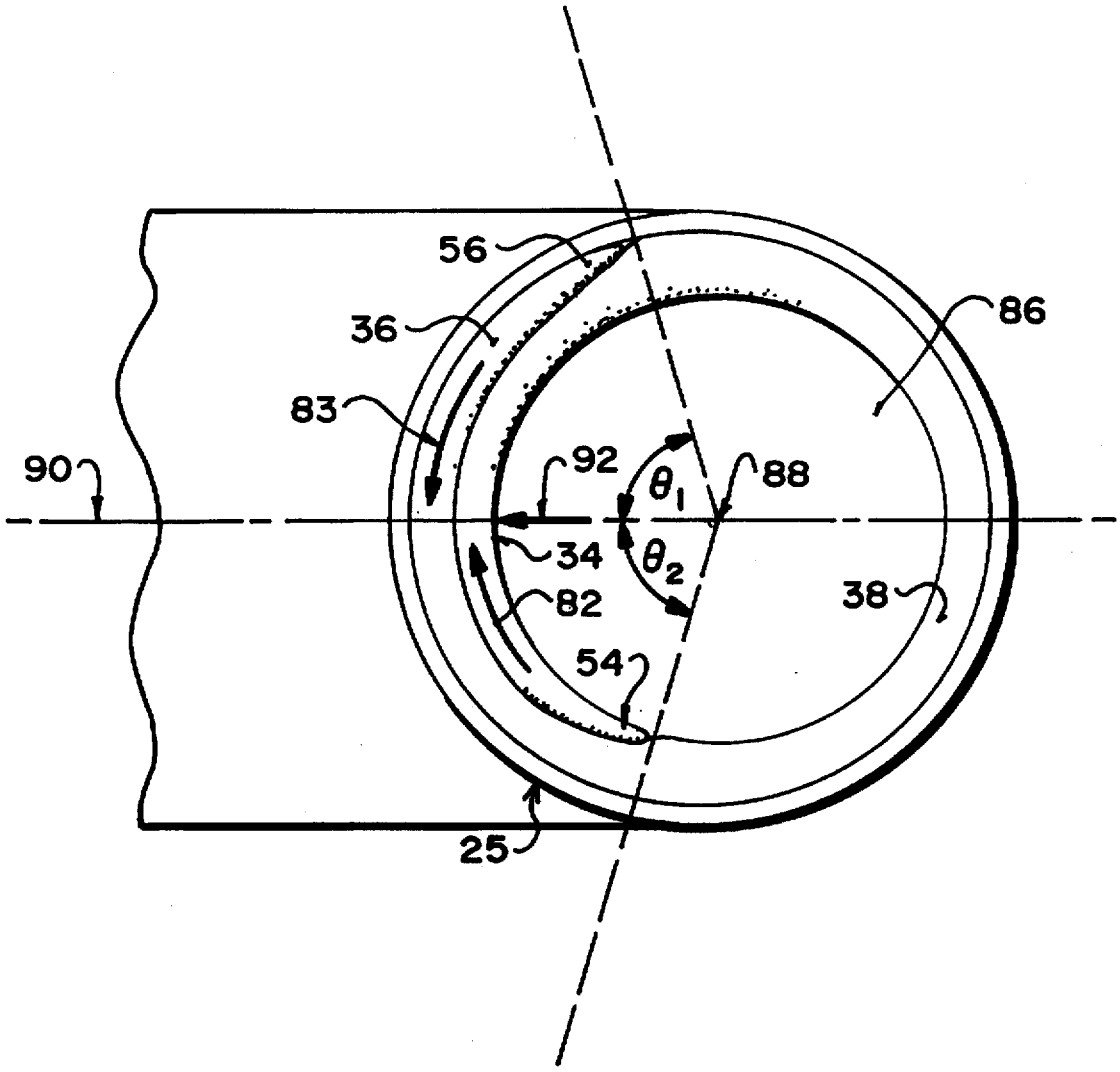
FIG. 8 is a schematic top plan view of the cuff of a ski boot comprising the boot liner of FIG. 1.

The geometry of the cuff 38 of liner 20 is illustrated in FIG. 8. Cuff 38 forms a generally rounded opening 86 to fit around the wearer's shin and calf. From a point 88 in the centre of opening 86, the angle subtended by the free end 54 of flap 34 and the free end 56 of flap 36 as seen from point 88 is preferably more than 100 degrees and is preferably approximately 130 degrees. This angle is illustrated as $\theta_1+\theta_2$ in FIG. 8. The angle between the free end 54 of flap 34 and a mid-plane 90 which generally bisects liner 20 is preferably approximately the same as the angle between the free end 56 of flap 36 and mid-plane 90. That is, preferably $\theta_1 \approx \theta_2$. When this is the case, and the wearer flexes his or her leg forward the pressure applied by the front of the wearer's shin to the inner surface of flap 34 as indicated by arrow 92 is almost entirely transmitted from flap 34 through flap 36 to boot shell 25. When the wearer flexes his or her leg forward the portion of liner 20 surrounding opening 86 remains snug but not tight. Preferably the free edge 54 of inner flap 34 does not extend far enough around a wearer's leg to press into the wearer's calf muscle.

When a person wearing a boot with a liner according to the invention flexes his or her leg forward the front of the wearer's shin presses on the inside of flap 34 as indicated by arrow 80 (FIG. 8). Flap. 36 is then compressed between flap 34 and shell 25. Cuff 38 of liner 20 cannot loosen about the wearer's calf and shin unless flap 34 slips relative to flap 36 (as indicated by arrows 82 and 83). However, the more the wearer flexes his or her leg forward in the boot, the more pressure is applied to squeeze flap 36 between flap 34 and shell 25 and the greater is the friction between flap 34 and flap 36. The friction between flaps 34 and 36 acts to prevent flap 36 from slipping relative to flap 34 and therefore prevents cuff 38 from loosening whenever the wearer's shin is exerting pressure on the inside of flap 20. Because cuff 38 of liner 20 is prevented from opening as described above, it is not necessary for the boot shell to be tight when the wearer's leg is not flexed. Thus a boot with a liner according to the invention may be more comfortable to wear than a boot with a conventional liner while providing the wearer with good control over the boot.

The friction between flap 34 and flap 36 may be made greater, and the resistance of liner 20 to opening may be consequentially increased, by providing one or more areas having an increased coefficient of friction on the outer surface of inner flap 34 or the inner surface of outer flap 36 or on both. This may be accomplished by roughening the surface of the material of which the flaps are made or by attaching one or more pieces of material having a relatively high coefficient of friction between flaps 34 and 36.

An advantage of the above-noted design is comfort. Overlapping flaps 20 and 22 provide two layers of padding in front of the wearer's shin. This prevents pressure spots on the wearer's shin and contributes to ideal boot flex characteristics. In a conventional boot liner with a tongue there is often a lump in the liner at the point at which the tongue attaches to the rest of the liner. This can cause a pressure spot on the top of the wearer's foot. This disadvantage is not present in a liner made according to the invention.

Figure 9:
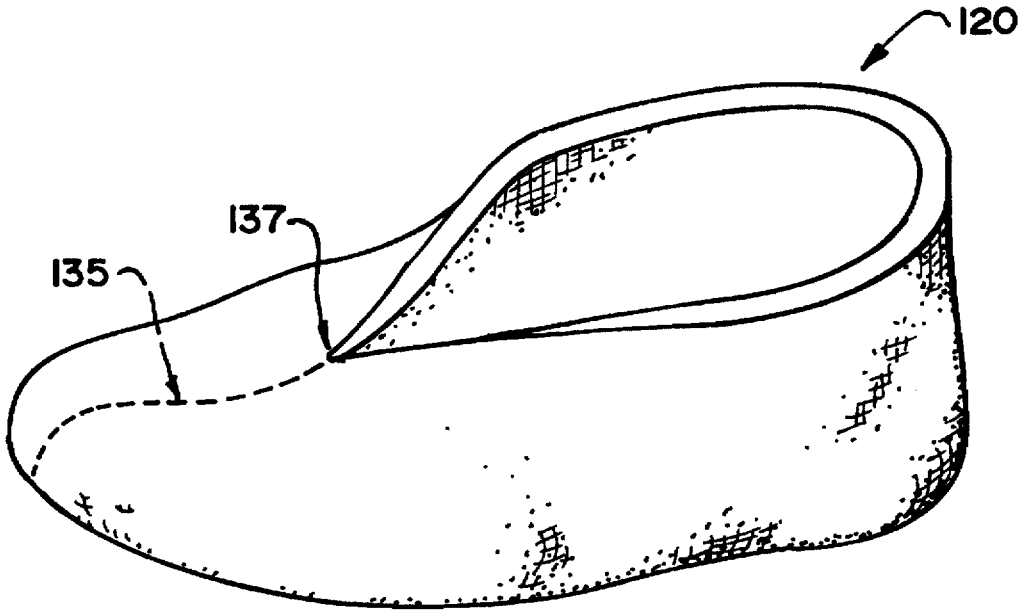
FIG. 9 is a perspective view of an alternative liner according to the invention.
Figure 10:
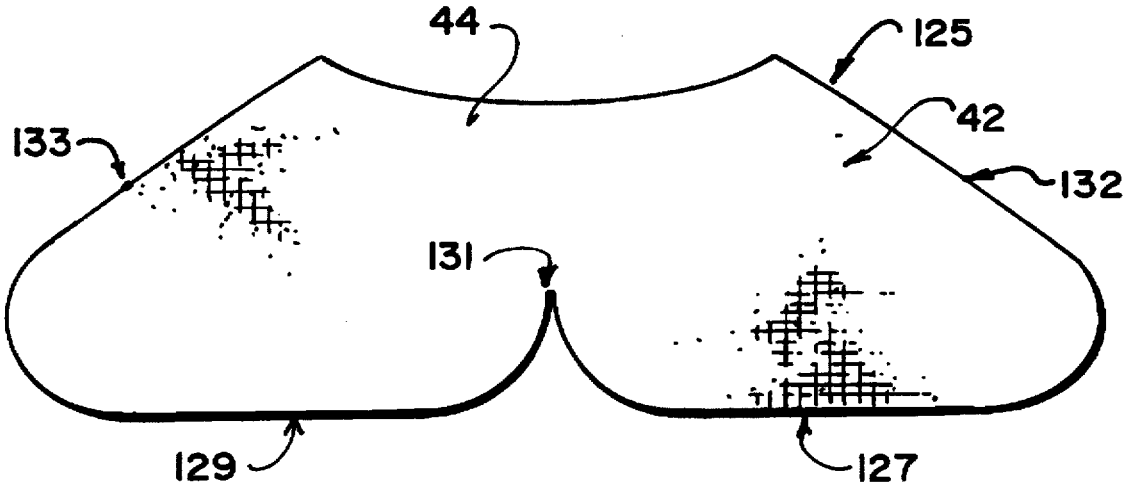
FIG. 10 is a plan view of a blank of sheet material cut to form the liner of FIG. 9.

FIGS. 9 and 10 illustrate an alternative liner which is adapted for use in a hiking boot. Liner 120 shares the characteristics that it can be readily formed from a single piece of thermoformable material cut from a sheet and it is fitted to both the wearer's foot and the inside of a boot shell.

Liner 120 is made by cutting a blank 125 of thermoformable material 42 from a sheet of generally uniform thickness. Material 42 is preferably laminated on both sides with fabric 44 as described above. Blank 125 is formed into an unfitted liner by joining edge 127 to edge 129 between point 131 and points 132, and 133 to form seam 135. Point 137 on liner 120 corresponds to points 132 and 133. The unfitted liner is formed into liner 120 by the same sequence of steps, described above with respect to liner 20 except that the steps related to forming flaps 34 and 36 are omitted because liner 120 has no flaps. The inner surface of liner 120 is fitted to a wearer's foot and the outer surface of liner 120 is fitted to the inside of a boot shell (not shown).

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method for forming a custom-fitted sport boot liner for wearing inside a sport boot shell, said liner comprising a thermoformable material, said material having a thermoforming temperature, said method comprising the steps of:

(a) providing an unfitted liner comprising a sheet of a thermoformable material having first and second side edges, said side edges defining free edges of first and second thermoformable wings, each of said wings capable of being wrapped substantially completely across a wearer's shin;

(b) heating said unfitted liner to a temperature above said thermoforming temperature; and, (c) fitting said liner to said wearer's foot by the steps of:

(d) placing a wearer's foot and lower leg into said unfitted liner with said foot in said foot-receiving portion and said lower leg in said lower-leg receiving portion;

(e) wrapping said first wing in front of said wearer's lower leg in a first direction until said first wing extends substantially entirely across a front surface of said wearer's lower leg;

(f) wrapping said second wing in front of said wearer's lower leg outside of and overlapping with said first wing in a second direction, opposite to said first direction, until said second wing extends substantially entirely across said front surface of said wearer's lower leg to form a double thickness of said thermoformable material in a region forwardly adjacent and extending substantially entirely across said wearer's shin; and, (g) placing said wearer's foot and lower leg and unfitted liner inside said sport boot shell to simultaneously shape an inside surface of said unfitted liner to conform to said wearer's foot and lower leg and an outside surface of said unfitted liner to conform to an inside surface of said sport boot shell.

2. The method of claim 1 wherein said first and second wings form a double thickness of thermoplastic material in a region upwardly adjacent said wearer's forefoot and said step of wrapping said first wing in front of said wearer's lower leg comprises bending a lower portion of said first wing to form a compound curve conforming generally to a compound curve defined by forward facing portions of said wearer's forefoot, ankle and shin.

3. The method of claim 2 wherein said step of wrapping said second wing in front of said wearer's lower leg comprises bending a lower portion of said second wing to conform generally to said compound curve defined said first wing in said region.

4. The method of claim 3 wherein said step of fitting said liner to said wearer's foot comprises the step of placing an elastic sleeve around said unfitted liner to compress said unfitted liner against said wearer's foot and lower leg after said step of wrapping said second wing in front of said wearer's lower leg and before said step of placing said wearer's foot and lower leg and unfitted liner inside said sport boot shell.

5. The method of claim 4 wherein said first direction is a direction from the outside of said wearer's foot toward the inside of said wearer's foot.

6. The method of claim 4 wherein said unfitted liner is formed from a single unitary flat blank of thermoplastic foam material having a uniform thickness.

7. The method of claim 6 wherein said inner surface of said sport boot shell comprises a plurality of indentations and said step of shaping an outside surface of said unfitted liner to conform to an inside surface of said sport boot shell comprises forming projecting areas on said outer surface of said liner corresponding to said indentations.

8. The method of claim 1 wherein said step of providing said unfitted liner comprises providing a layer of fabric laminated to and covering each side of said sheet of said thermoformable foam material.

9. A sport boot liner for wearing inside a sport boot shell said liner comprising a hollow foot receiving portion and a hollow lower-leg receiving portion extending generally perpendicularly from a rearward end of said foot-receiving portion; said foot-receiving portion having a heel receiving portion at said rearward end a toe-receiving portion at a forward end, and a forefoot region on an upper surface thereof forward from said lower-leg receiving portion and rearward from said toe-receiving portion; said lower-leg receiving portion comprising a rearward facing calf receiving portion, an ankle-receiving area, a forward-facing shin receiving portion extending laterally entirely across a forward-facing face of said lower-leg receiving portion and extending upwardly from said foot receiving portion to a top edge, said top edge defining a rounded opening and first and second side edges defining a further opening for insertion of a wearer's lower-leg; wherein:

(a) said first side edge defines a free edge of a first curved flap wrapped in a first direction substantially entirely across said shin receiving portion;

(b) said second side edge defines a free edge of a second curved flap wrapped in a second direction, opposite to said first direction, substantially entirely across said shin receiving portion and overlapping with said first flap in an overlap region extending laterally substantially entirely across said shin receiving portion;

(c) said first and second curved flaps comprise curved sheets of thermoformable foam material wherein said first and second flaps overlap substantially continuously along a line extending from said top edge into said forefoot region of said foot receiving portion; and, (d) said sport boot liner comprises a layer of friction material between said first and second flaps.

10. The sport boot liner of claim 9 wherein said sheets of foam material comprise a thermoplastic foam material having a thermoforming temperature not greater than 115 C.

11. The sport boot liner of claim 10 wherein said overlap region extends vertically between said top edge and a point located centrally on said upper surface of said foot-receiving portion forward from said ankle-receiving area and rearward from said toe-receiving portion, said overlap region comprising a saddle-shaped area of compound curvature in said forefoot region, said saddle shaped area having an inner surface shaped to conform to contours of a human foot.

12. The sport boot liner of claim 10 wherein, in a region adjacent said top edge, said overlap region subtends an angle of at least 100 degrees relative to a point centred in said rounded opening.

13. The sport boot liner of claim 12 wherein, in said region adjacent said top edge, relative to said point centered in said rounded opening, said overlap region subtends angles greater than 40 degrees to each of two sides of a vertical plane bisecting said shin receiving portion.

14. The sport boot liner of claim 13 wherein said angles are each greater, than 50 degrees.

15. The sport boot liner of claim 10 wherein said lower leg receiving portion and said foot receiving portion comprise a unitary sheet of thermoformable foam material.

16. The sport boot liner of claim 10 comprising by a layer of stretch fabric laminated to and covering each side of said unitary sheet of thermoformable foam material.

* * * * *